US006286781B1

(12) United States Patent
Lai

(10) Patent No.: US 6,286,781 B1
(45) Date of Patent: Sep. 11, 2001

(54) HOLDER FOR A ROLL OF PAPER

(76) Inventor: Yuan-Tse Lai, No. 17, Alley 58, Lane 102, Sec. 2, Changshui Rd., Hsiushui Hsiang, Changhua Hsien (TW)

( * ) Notice: Subject to any disclaimer, the term of this patent is extended or adjusted under 35 U.S.C. 154(b) by 0 days.

(21) Appl. No.: 09/657,586

(22) Filed: Sep. 8, 2000

(51) Int. Cl.[7] ..... B65H 18/04
(52) U.S. Cl. ..... 242/596.4
(58) Field of Search ..... 242/596.3, 596.4, 242/596.5, 596.8, 596, 598.1, 598.2, 599.3, 599.4

(56) References Cited

U.S. PATENT DOCUMENTS 2,908,449 * 10/1959 Bolger .
2,978,197 * 4/1961 Anderson .
3,319,855 * 5/1967 Tucker et al. .
4,043,519 * 8/1977 Suzuki et al. .
4,553,710 * 11/1985 Pool .
4,662,576 * 5/1987 Paul .
5,782,428 * 7/1998 Chabot .
5,868,347 * 2/1999 Paul et al. .
6,189,828 * 2/2001 Reilly .

* cited by examiner

*Primary Examiner*—William A. Rivera
(74) *Attorney, Agent, or Firm*—Bacon & Thomas, PLLC

(57) ABSTRACT

A holder for a roll of paper has a back plate, a hollow side extending laterally from each end of the back plate, a cavity defined in each side, an opening defined in one end of each side and communicating with the cavity, a through hole defined in each side, a frame securely received in the cavity of each side and a tube post pivotally mounted on the frame and extending outward from the through hole of the side. A biasing member laterally extends from each end of each tube post and engages with the frame. By such an arrangement, the holder has no metal parts so the holder will not get rusty in any wet environment. The useful life of the holder will be prolonged.

7 Claims, 5 Drawing Sheets

HOLDER FOR A ROLL OF PAPER

BACKGROUND OF THE INVENTION

1. Field of the Invention

The present invention relates to a holder, and more particularly to a nonmetallic holder for a roll of paper including toilet paper, paper towels, etc.

2. Description of Related Art

With reference to FIG. 4, a holder for a roll of paper is mounted in the toilet, bathroom or kitchen to hold toilet paper, paper towels, etc. The conventional holder in accordance with the prior art comprises a bracket and two tube posts (46) pivotally mounted on the bracket. The bracket includes a back plate (40) and a side (42) extending from each end of the back plate (40). A recess (422) is defined in the inside face of each side (42). A frame (44) is securely received in each recess (422), and the tube post (46) is pivotally connected to each frame (44) by a pivot pin (47). A spring (48) is mounted on the pivot pin (47) to provide a biasing force to the corresponding tube post (46). By such an arrangement, the tube post (46) can extend into each end of the paper tube, such that the paper tube can be rotatably held on the holder. In addition, a cover (50) is pivotally mounted on the bracket, and a spring (54) is mounted on a pivot pin (52) that connects the cover (50) to the corresponding side (42) of the bracket.

However, because each frame (44) with the tube post (46) must be attached to the recess (422) from the gap between the sides (42), the space to mount the frame (44) is not enough. This will increase the difficulty of assembling the conventional holder. In addition, there are some metal elements like the pivots (47,52) and springs (48,54) in the conventional holder. The metal elements easily rust in the humid and wet environment in where the holder is mounted. The use life of the conventional holder will be shortened due to the rust.

With reference to FIG. 5, another conventional holder in accordance with the prior art comprises a back plate (60), two tube bar arms (62) attached to the back plate (60) and two tube bars (64) rotatably connected to the free end of the tube bar arms (62). The back plate (60) is securely attached to the wall of a toilet, bathroom or kitchen. A tube bar arm (62) is secured to each side of the back plate (60) by bolts (63). A tube bar (64) is rotatably mounted on the free end of each tube bar arm (62) by a pivot pin (66). A torsion spring (68) is mounted on each pivot pin (66) with the two ends respectively engaged with the tube bar arm (62) and the corresponding tube bar (64). By such an arrangement, each tube bar (64) can rotate relative to the tube bar arm (62) by pushing the paper tube, and the tube bar (64) will automatically extend into one end of the paper tube by the torsion force of the spring (68). Consequently, the paper tube can be rotatably held between the tube bars (64).

However, this embodiment requires that a recess be defined in the wall to receive the back plate (60), bolts (63) and pivot pin (66). This increases the difficulty of mounting the conventional holder on the wall. In addition, there are still metal elements like the bolts (63), pivot pin (66) and spring (68) in the conventional holder. The rusting of these elements cannot be avoided, so that the useful life of the conventional holder will also be shortened due to the rust.

To overcome the shortcomings, the present invention tends to provide an improved holder for rolls of paper to mitigate or obviate the aforementioned problems.

SUMMARY OF THE INVENTION

The main objective of the invention is to provide an improved holder for rolls of paper with no metal parts to avoid the formation of rust. The holder has a back plate, two hollow sides, a frame mounted in each side and a tube post pivotally mounted on each frame. A biasing member extends laterally from each end of each tube post and engages with the frame. By such an arrangement, the holder has no metal parts so the holder will not get rusty. The useful life of the holder will be prolonged.

Other objects, advantages and novel features of the invention will become more apparent from the following detailed description when taken in conjunction with the accompanying drawings.

DETAILED DESCRIPTION OF THE PREFERRED EMBODIMENT

Figure 1:
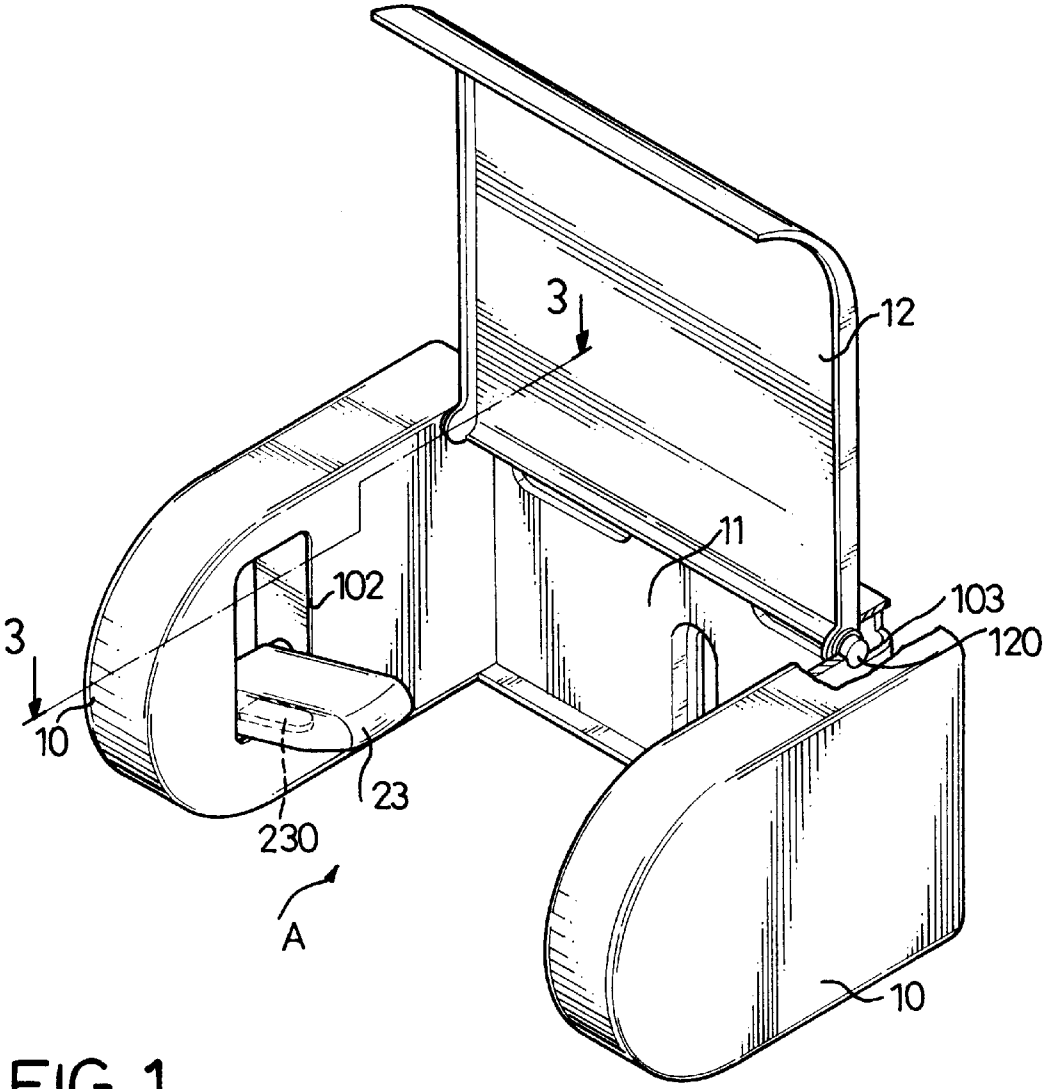
FIG. 1 is a perspective view of a holder for a roll of paper in partial section in accordance with the present invention.
Figure 2:
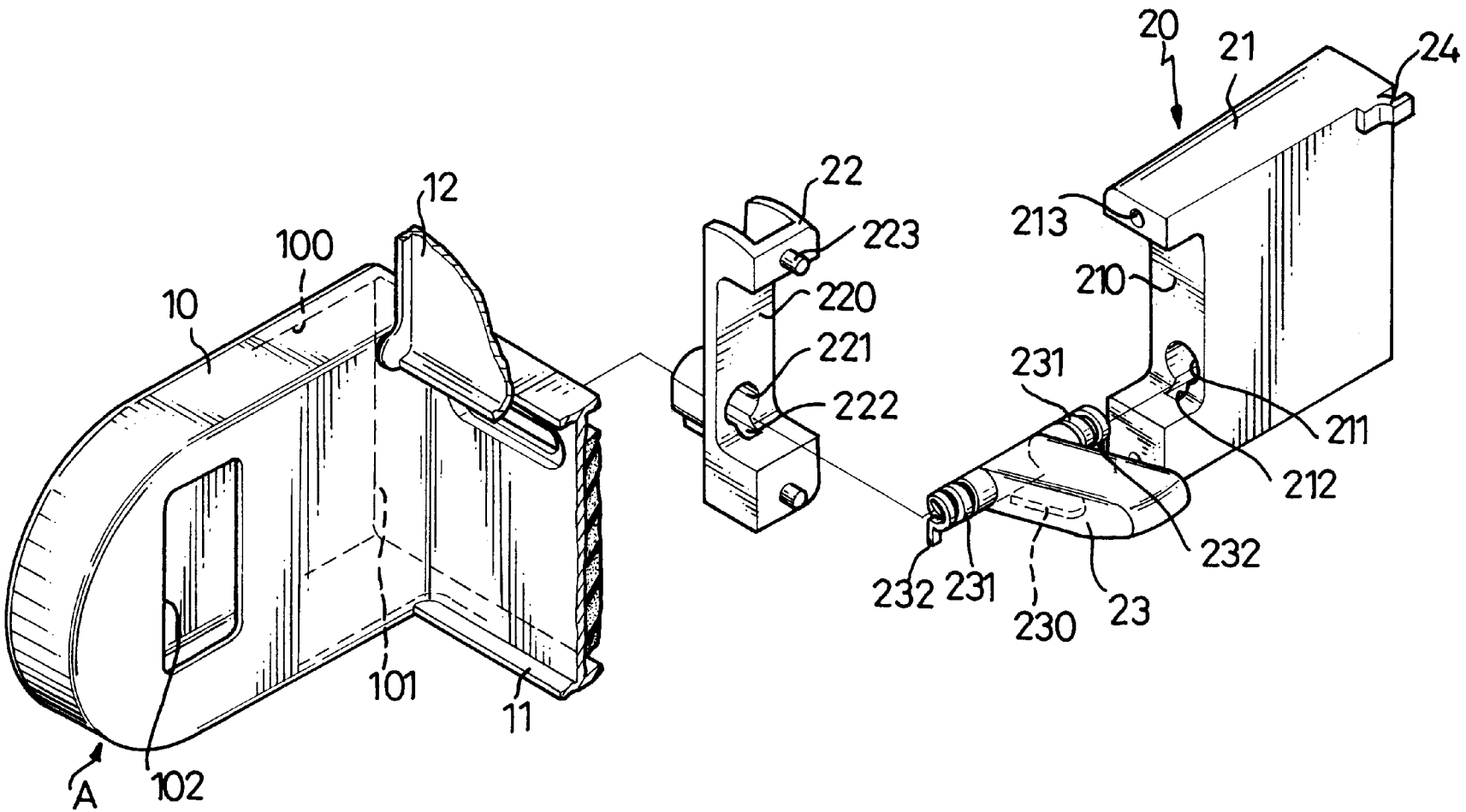
FIG. 2 is an exploded perspective view of partial section of the holder in FIG. 1.
Figure 3:
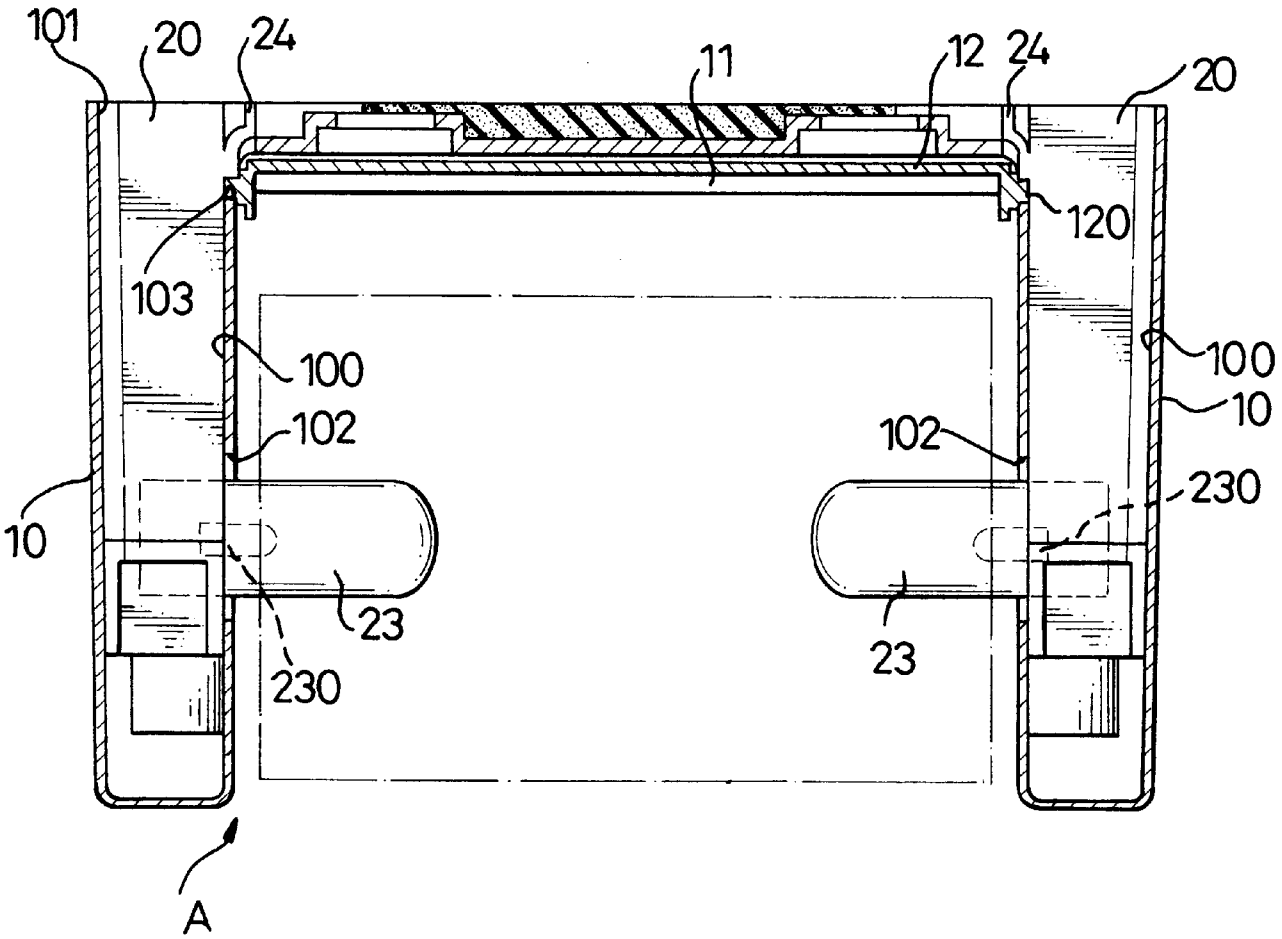
FIG. 3 is a top plan view in partial section of the holder along line 3—3 in FIG. 1.
Figure 4:
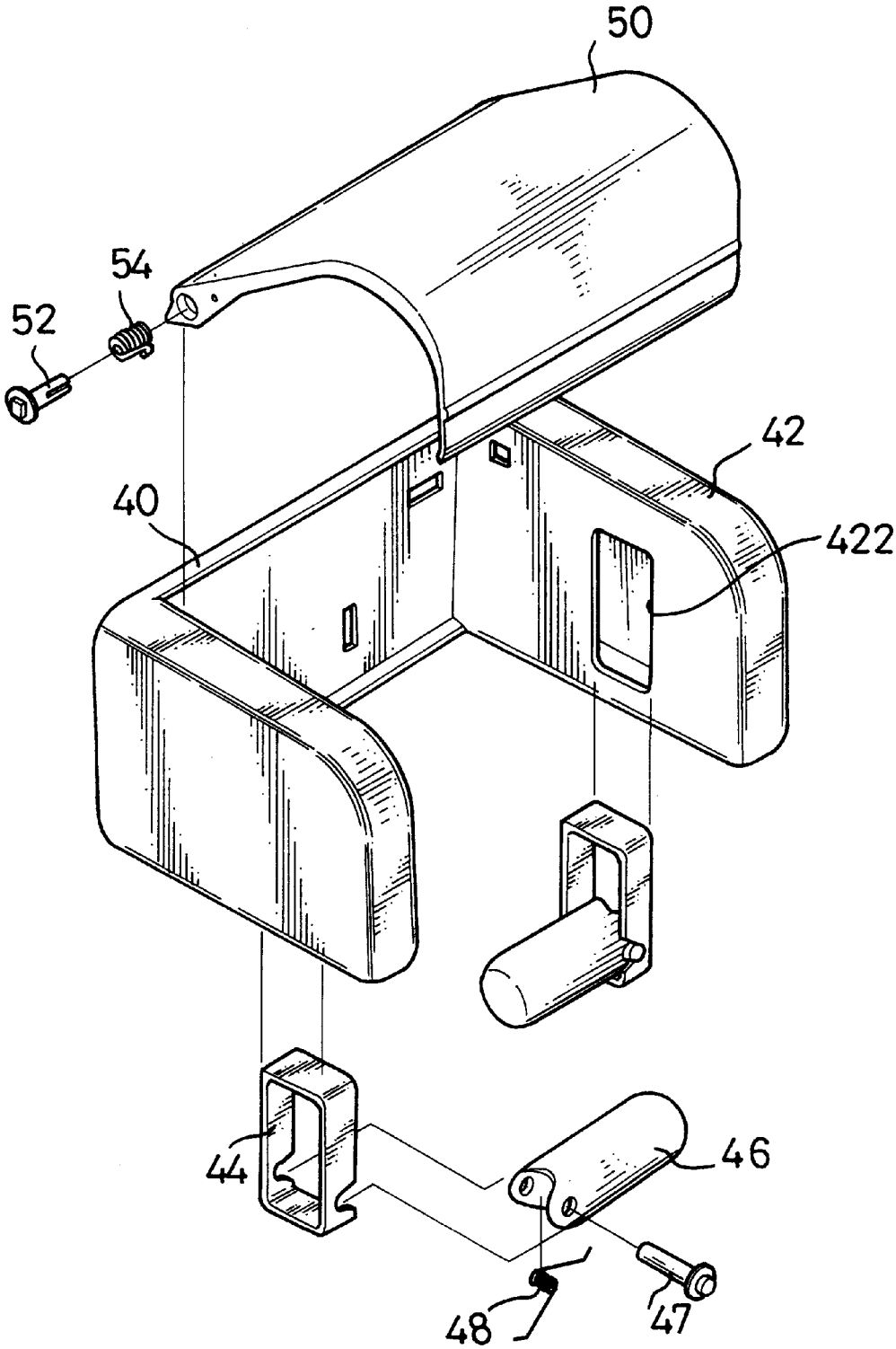
FIG. 4 PRIOR ART
FIG. 4 is an exploded perspective view of a conventional holder for a roll of paper in accordance with the prior art.
Figure 5:
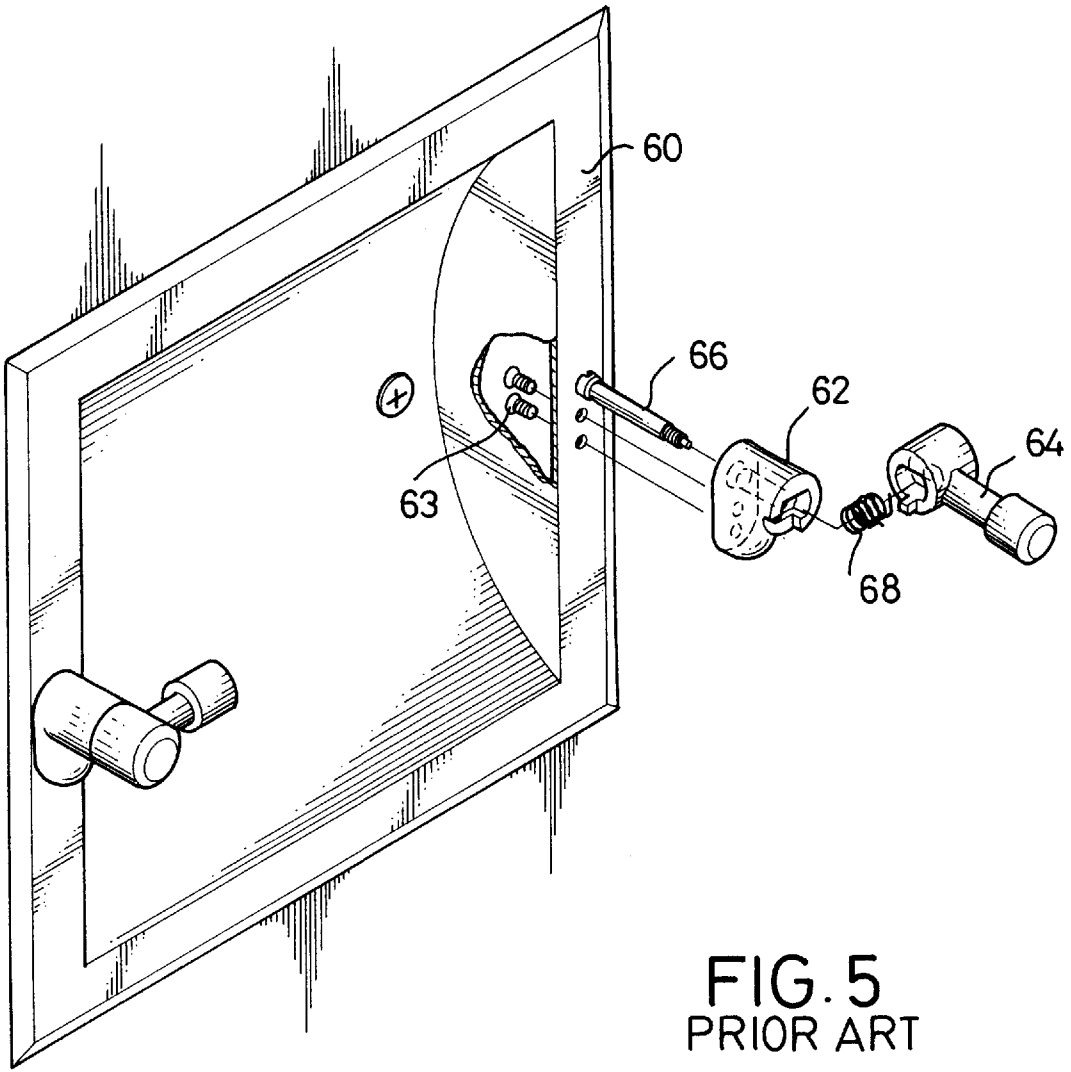
FIG. 5 PRIOR ART
FIG. 5 is an exploded perspective view of another conventional holder for a roll of paper in accordance with the prior art.

With reference to FIGS. 1–3, a holder (A) for a roll of paper in accordance with the present invention comprises a bracket, two internal frames (20) mounted in the bracket and a tube post (23) pivotally mounted in each frame (20) and extending outward from one bracket toward the other bracket. The bracket includes a back plate (11) and a hollow side (10) extending laterally from each end of the back plate (11) in the same direction. A cavity (100) is defined in each side (10) to receive one of the frames (20). An opening (101) is defined in one end of each side (10) and communicates with the cavity (100), such that each frame (20) can be inserted into the cavity (100) in each side (10) through the corresponding opening (101). The tube post (23) extends outward from a through hole (102) defined in each side (10) and faces the other through hole (102) defined in the other side (10).

Each internal frame (20) comprises a body (21) and a cap (22) detachably engaged with the body (21). In practice, a dowel (223) is formed on the cap (22), and a blind hole (213) is defined in the body (21) to securely receive the dowel (223) on the cap (22). The internal frame (20) is formed by the combination of the body (21) and the cap (20) through the engagement between the dowel (223) and the corresponding blind hole (213). A recess (210, 220) is defined in the body (21) and the cap (22) of the internal frame (20) to receive the tube post (23) in the recesses (210, 220) when the body (21) is combined with the cap (22).

The tube post (23) has a biasing member (231) extending laterally from each end. A protrusion (232) is formed on each biasing member (231). A pivot hole (211, 221) is defined in the face of each recess (210, 220) to receive one of the biasing members (231) on the tube post (23), such that the tube post (23) can be pivotally mounted between the body (21) and cap (22). A longitudinal groove (212,222) is defined in the inner periphery of each pivot hole (211, 221) to engage the protrusion (232) of the biasing member (231) received in the pivot hole (211, 221). Thereby, each biasing member (231) can provide a torsion force to the tube post(23).

During assembly, the tube post (23) is first mounted between the body (21) and cap (22) of the internal frame (20). Then, the tube post (23) is rotated parallel with the frame (20), and the frame (20) with the tube post (23) is inserted into the cavity (100) of each side (10) through the opening (101). When the tube post (23) aligns with the through hole (102), the tube post (23) will automatically extend out from the through hole (102) due to the torsion force of the biasing members (231). The frame (20) will be securely received in the cavity (100) due to the engagement between the tube post (23) and the through hole (102). Consequently, the roll of paper can be rotatably held in the holder as each tube post (23) inserts into each end of the paper tube. A block (230) is integrally formed on the bottom of each tube post (23), such that the block (230) will abut the inner edge of the through hole (102) when the tube post (23) extends outward from the through hole (102). This can support the tube post (23) above horizontal to keep the tube post (23) from inclining down.

By such an arrangement, because the frame (20) with the assembled tube post (23) is inserted through the opening (101) defined in one end of each side (10), there is no problem with space to assemble the holder. In addition, because the biasing members (231) are integrally formed on the tube post (23), there is no metal in the holder. The components of the holder will not get rusty even when the holder is attached to the wall of a wet environment like a toilet or kitchen. The useful life of the holder can be prolonged.

A cover (12) is pivotally mounted between the two sides (10) to cover the roll of paper mounted in the holder. A stub (120) extends from each end of the cover (12). A passage (103) is defined in each side (10) to receive the stub (120) to pivotally connecting the cover (10) to each side (10). In addition, a stop (24) is formed on each internal frame (20) and extends into the passage (103) of the side (10) to abut the stub (120) of the cover (12). This can provide a limitation effect to the stub (120) of the cover (12) to keep the cover (12) from disengaging from the bracket through the opening (101).

It is to be understood that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A holder for a roll of paper comprising:

a back plate;

a hollow side extending laterally from each end of the back plate in the same direction, each side having a cavity defined therein, an opening defined in one end thereof and communicating with the cavity; and a through hole defined therein and facing the other through hole defined in the another side;

a frame securely received in the cavity of each side; and a tube pest pivotally mounted on the frame and extending outward from the through hole of the side in which the frame with the tube post is mounted;

wherein a biasing member extends laterally from each end of each tube post and engages with the frame;

wherein the frame is composed of a body and a cap detachably engaged with the body such that the tube post is mounted between the body and cap;

wherein a recess is defined in each member of the frame to receive the tube post; and wherein a pivot hole is defined in a face of each recess to receive one of the biasing members of the tube post.

2. The holder as claimed in claim 1, wherein a block is integrally formed on a bottom of each tube post to abut an inner edge of the through hole from where the tube post extends outward.

3. The holder as claimed in claim 1, wherein a longitudinal groove is defined in an inner periphery of each pivot hole; and a protrusion is formed on each biasing member to engage with the longitudinal groove of each pivoting hole in which the biasing member is received.

4. The holder as claimed in claim 1, wherein a dowel is formed on the cap; and a blind hole is defined in the body to securely receive the dowel of the cap.

5. The holder as claimed in claim 1 further comprising a cover pivotally mounted between the two sides.

6. The holder as claimed in claim 5, wherein a stub extends from each end of the cover to pivotally connect with each side; and a passage is defined in each side to receive the stub with which the side connects.

7. The holder as claimed in claim 6, wherein a stop is formed on each internal frame and extends into the passage of the side to abut the stub of the cover.

* * * * *